US005386596A

United States Patent [19]

Hennessy

[11] Patent Number: 5,386,596

[45] **Date of Patent: * Feb. 7, 1995**

[54] WATER SAVER TOILET

[75] Inventor: Arnold Hennessy, Wellington, Canada

[73] Assignee: Fluidmaster, Inc., Anaheim, Calif.

[ * ] Notice: The portion of the term of this patent subsequent to Sep. 1, 2009 has been disclaimed.

[21] Appl. No.: 124,388

[22] Filed: Sep. 20, 1993

Related U.S. Application Data

[63] Continuation-in-part of Ser. No. 870,569, Apr. 17, 1992, which is a continuation-in-part of Ser. No. 618,170, Nov. 26, 1990, Pat. No. 5,142,712.

[51] Int. Cl.[6] ..... E03D 3/10; E03D 11/18

[52] U.S. Cl. ..... 4/328; 4/354; 4/424

[58] Field of Search ..... 4/328, 329, 332, 347, 4/354, 359, 361, 362, 424, 360, 364; 222/339, 341, 387

[56] References Cited

U.S. PATENT DOCUMENTS

| | | | |
|---|---|---|---|
| 255,485 | 3/1882 | Boyle | 4/328 |
| 378,664 | 2/1888 | Demarest | 4/328 |
| 380,854 | 4/1888 | Boyle | 4/344 |
| 391,318 | 10/1888 | Harkins | 4/328 |
| 461,213 | 10/1891 | Boyle | 4/328 |
| 530,306 | 12/1894 | Harvey | 4/328 |
| 534,689 | 2/1895 | Hamilton | 4/425 |
| 541,274 | 6/1895 | Hamilton | 4/424 |
| 558,130 | 4/1896 | Wallace | 4/328 |
| 4,800,596 | 1/1989 | Menge | 4/348 |
| 5,142,712 | 9/1992 | Hennessy | 4/328 X |

FOREIGN PATENT DOCUMENTS

| | | |
|---|---|---|
| 1207 | of 1874 | United Kingdom . |
| 889 | of 1882 | United Kingdom . |
| 172 | of 1905 | United Kingdom . |
| 397066 | 8/1933 | United Kingdom . |
| 485689 | 5/1938 | United Kingdom . |

*Primary Examiner*—Robert M. Fetsuga
*Attorney, Agent, or Firm*—Arthur Freilich; Robert D. Hornbaker; Leon D. Rosen

[57] ABSTRACT

A water saver toilet is provided, of the type that applies a vacuum to the toilet bowl outlet to assist flushing, which effectively uses the vacuum. The toilet bowl outlet includes upper and lower trap devices (44, 50 in FIG. 2) connected by a trapway (46), with the lower trap device being initially unobstructed. At the beginning of flushing, the initial water flow causes obstruction of the lower trap device to air flow, and a vacuum is then applied to the trapway to pull out water and debris from the toilet bowl. One toilet (FIG. 5) is of the urinal type, and includes a container (214) lying within a water tank, with the lower end (218) of the container opening to the water tank, and with the upper end (219) of the container connected by a vertical vacuum pipe (221) to the trapway.

6 Claims, 4 Drawing Sheets

WATER SAVER TOILET

CROSS-REFERENCE TO RELATED CASES

This is a continuation-in-part of U.S. patent application Ser. No. 07/870,569 filed Apr. 17, 1992, which is a continuation-in-part of Ser. No. 07/618,170 filed Nov. 26, 1990 now U.S. Pat. No. 5,142,712.

BACKGROUND OF THE INVENTION

Many cities are attempting to conserve water by reducing the amount used in each toilet flushing. One approach is to apply a vacuum to the toilet bowl outlet near the beginning of each flushing to suck out water and debris to flow into a drain pipe. One old patent, Boyle U.S. Pat. No. 380,854, issued Apr. 10, 1888, describes a vacuum assisted toilet, where the bowl outlet includes upper and lower traps that are always sealed against the passage of air. The presence of two traps can allow all water from the toilet bowl to be siphoned into the drain, and allow sewer gas to leak through the toilet bowl into the environment, A vacuum assisted toilet which avoided possible loss of all water in the toilet bowl while effectively using the applied vacuum, would be of considerable value.

SUMMARY OF THE INVENTION

In accordance with one embodiment of the present invention, a vacuum assisted toilet is provided which is highly effective and reliable. The toilet includes a bowl outlet with a pair of trap devices and a trapway between them to which a vacuum is applied during flushing. The lower trap device includes a trapping region that completely fills with water during flushing to provide a vacuum seal, but which is unobstructed to the flow of air along its top when no water is flowing therethrough. The lower trapway prevents dissipation of the vacuum applied to the trapway during flushing, and prevents the possibility of siphoning out all water from the toilet bowl after a flushing.

One toilet includes a sealed container lying within a water tank. The bottom of the container is connected to the water tank, and the top of the container is connected through a vacuum pipe to the trapway. A urinal toilet of this type includes a vertical vacuum pipe that extends through the bottom of the water tank to the top of the trapway.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
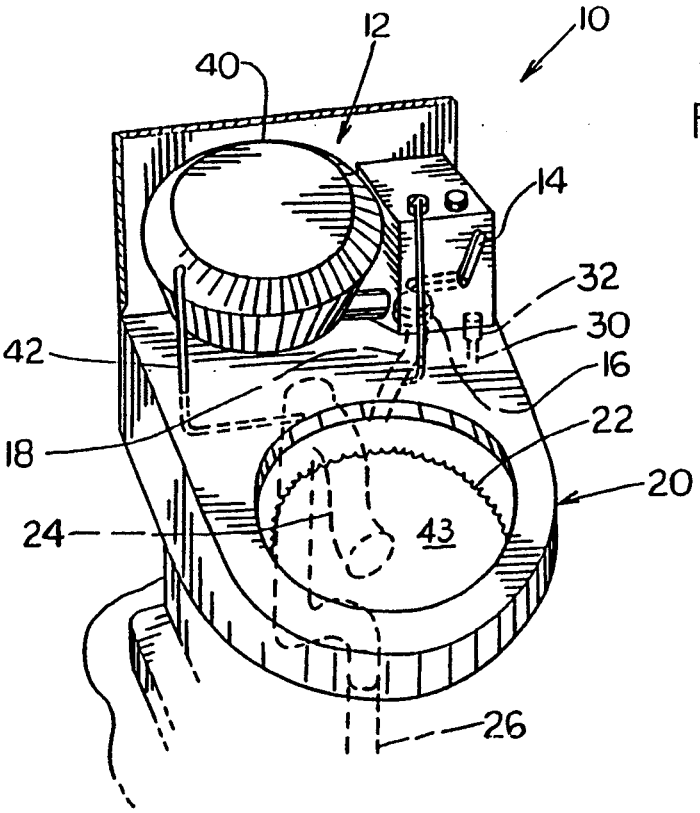
FIG. 1 is a partial sectional isometric view showing a vacuum assist sit-down toilet constructed in accordance with one embodiment of the present invention.

FIG. 1 illustrates a low profile pressured-water toilet 10 which includes a water and vacuum apparatus 12 that contains flush water. A person can move a lever 14 to open a flush valve 16 that allows water stored in the water and vacuum apparatus to move through a flush conduit 18 into a toilet bowl 20. Water flushed into the toilet bowl raises the water level from an initial level 22, to cause water and any debris in the toilet bowl to flow out of a toilet bowl outlet 24 that carries water and waste to a drain 26 that connects to a sewer system. During a flushing, water flows rapidly into the toilet bowl and water and debris moves out of it. During a period of perhaps forty-five seconds after a flushing, water from a household water supply 30 flows through an inlet valve 32, with most of the water flowing into the container apparatus 12 to refill it and ready it for the next flushing. Part of the inflowing water flows through the flush conduit 18 into the toilet bowl 20 to refill it to the initial level 22. In large cities, the pressure of water supply to the inlet valve 32 is always a plurality of psi (pounds per square inch) and is usually much more than 20 psi (1.4 bar).

The toilet 10 is a vacuum assisted type, wherein a vacuum from a vacuum source 40, which happens to be part of the water and vacuum apparatus 12, is applied through a vacuum conduit 42 to the toilet bowl outlet 24 to apply a vacuum therein during flushing of the toilet. The vacuum draws water and waste from the water pool 43 in the toilet bowl to efficiently flush the toilet bowl.

Figure 2A:
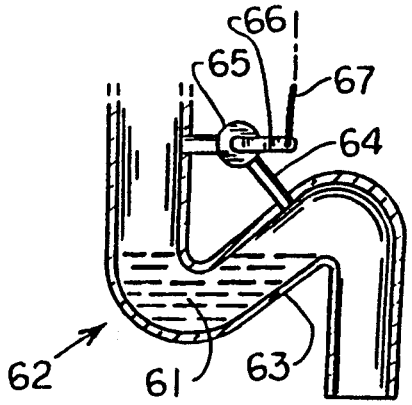
FIG. 2A is a sectional side view of a lower trapway device constructed in accordance with another embodiment of the invention, which can be used with the toilet of FIG. 1.
Figure 2:
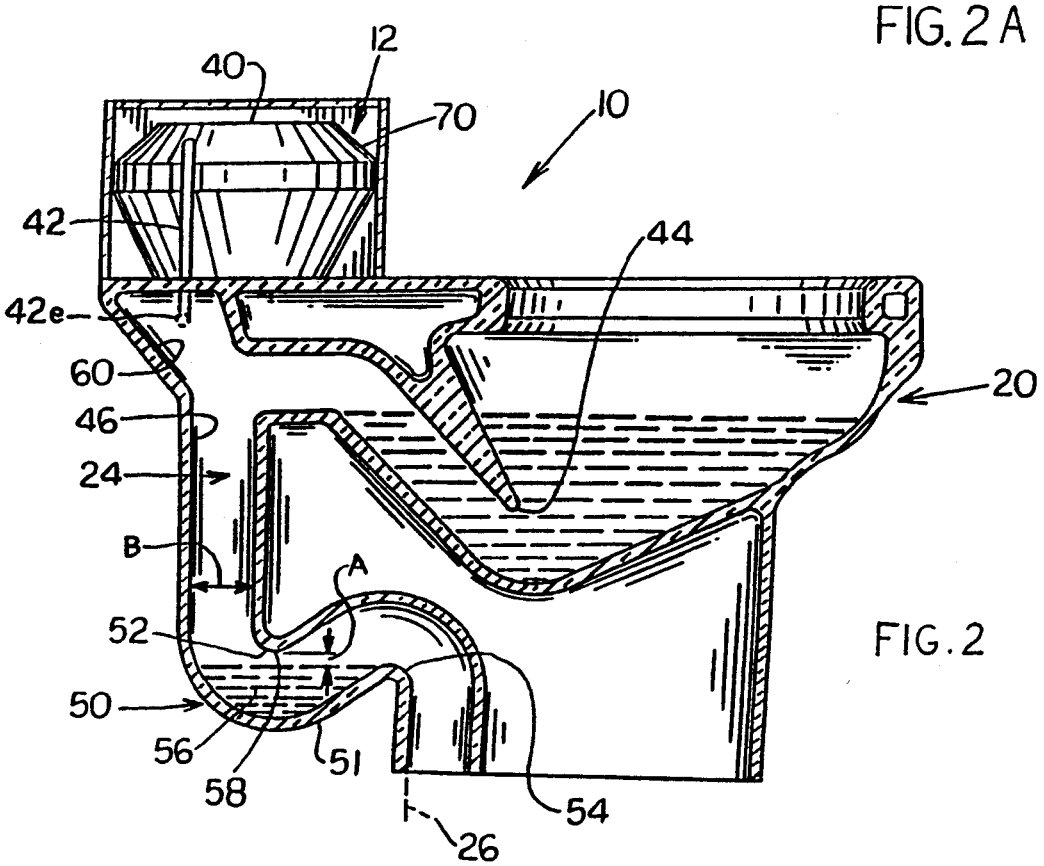
FIG. 2 is a sectional side view of the toilet of FIG. 1.

As shown in FIG. 2, the toilet bowl outlet 24 includes an upper trap device 44 coupled to the toilet bowl, and a trapway 46 extending from the upper trap device to a lower trap device 50 that leads to the drain 26. The lower trap device includes a conduit portion 51 extending at an upward incline in a downstream direction. The top 52 of the inside wall of the upstream end of the conduit portion, lies slightly higher than the bottom 54 of the outside wall of the downstream end of the upwardly inclined conduit portion. The result is a lower trap pool 56, with the top of the pool lying a small distance A below the top or uppermost location 52. This leaves a trap region 58 that is initially open to allow gas to flow therethrough, which avoids siphoning out water from the toilet bowl between flushings. However, early during a flushing, water fills the lower trap device to above the location 52, which prevents a vacuum applied to the trapway 46, from being dissipated through the drain 26.

The distance A is preferably small, being less than half the width B of the trapway and of the conduit forming the lower trap 50. The traps and trapway generally have a considerable minimum width such as two inches (5 cm) to assure the reliable flow of debris therethrough. A small gap A such as one-half inch (1.3 cm) is desirable so that a vacuum can be established in the lower trapway near the beginning of flushing, soon after water first flows out of the toilet bowl.

The end **42*e* of the vacuum conduit can be placed anywhere that is in direct communication with the trapway 46. Applicant prefers to make the connection in a cavity 60** lying above the path of water flowing through the trapway to resist the entrance of water into the vacuum conduit.

FIG. 2A illustrates another lower trap device 62 which includes a conduit portion 63 extending at an upward incline (in a downstream direction) to a sufficient height to create a pool of water 61 that always blocks the flow of air. However, a bypass air conduit 64 connects locations on opposite sides of the water pool, through a valve 65 that is normally open. A valve actuator 66 is moved near the beginning of a flushing, to temporarily close the valve and block air flow through it. The particular valve actuator 66 is moved by a chain 67 that is pulled when the flush lever 14 (FIG. 1) is moved. However, the valve actuator could be actuated by a vacuum applied along line 42 (FIG. 2), or by the inflow of water along pipe 30 (FIG. 1), or other event occurring within about a second after the beginning of a flushing. The valve 65 remains closed for a period between two and twenty seconds after it is first closed. This period is long enough to avoid dissipating any vacuum applied, but is short enough to avoid syphoning out water from the toilet bowl as it is refilled.

Figure 3:
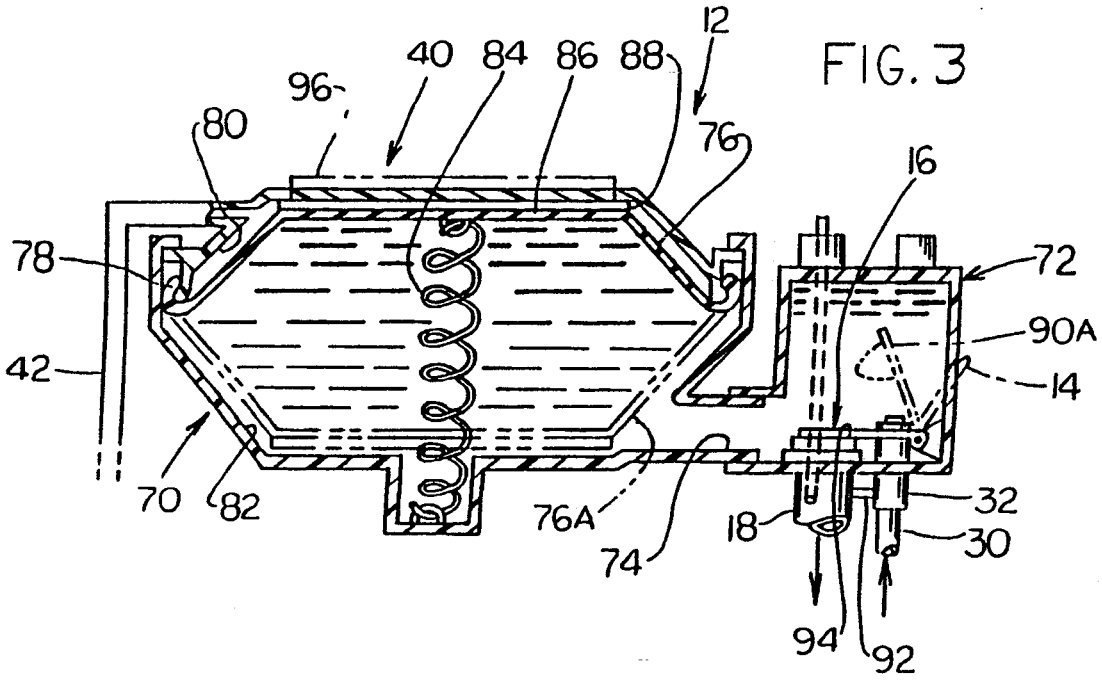
FIG. 3 is a partial sectional view of the toilet of FIG. 1, showing the container apparatus thereof.

FIG. 3 illustrates details of the water and vacuum apparatus 12 and of the vacuum source 40 thereof. The container apparatus includes a large water and vacuum 70 and a valve box 72, the two of them being connected by a large transfer opening 74. A diaphragm device 76 is provided which is in the form of a diaphragm with a periphery 78 sealed to the walls of the container to divide the container into a vacuum chamber 80 and a water chamber 82. Between flushings, the water chamber 82 is completely filled with water. A biasing device 84 in the form of a tension spring (a weight 96 could be used), tends to pull down the middle 86 of the diaphragm, which is rigidized by a plate 88. When the flush lever 14 is moved, a flush valve member pivots up off a valve seat 94 to the open position shown at 90A. With the flush valve 16 opened, water lying in the valve box 72 and in the water chamber 82 can move out of the flush conduit 18 to the toilet bowl to begin a flushing.

As water flows rapidly out of the water chamber 82 and valve box 72 of the container apparatus, the diaphragm device 76 rapidly moves down to its down position shown at 76A. The spring biasing device 84 assures rapid downward movement of the diaphragm device, as well as creating a large pressure head. With the diaphragm rapidly moving down, the vacuum chamber 80 rapidly expands in volume, creating a vacuum therein which is coupled through vacuum conduit 42 to the trapway of the toilet bowl outlet. Thus, as water begins flowing into the toilet bowl to begin moving water and debris into the toilet bowl outlet, the vacuum source 40 applies a vacuum to the trapway of the toilet bowl outlet to enhance the movement of water and debris out of the toilet bowl towards the drain. The use of a vacuum to enhance flushing, reduces the amount of flush water required to effectively flush the toilet bowl.

Towards the end of the flushing, when the diaphragm device reaches its down position 76A, the pressure of water in the water chamber 82 and valve box 72 of the container apparatus decreases and the inlet valve 32 opens. Water then flows through the household water supply pipe 30, through the inlet valve 32 into the valve box 72 and into the water chamber 82 to refill it. As the water flows in through the inlet valve 32, the pressure of the inflowing water raises the diaphragm device back up to the position 76, so that any further inflow of water would greatly increase the pressure of water in the container apparatus. The inlet valve 32 then closes, While the inlet valve 32 is open, a portion of the water flowing through it flows through a refill pipe 92 and through the flush conduit 18 to a toilet bowl to refill the toilet bowl to its original level.

Figure 4:
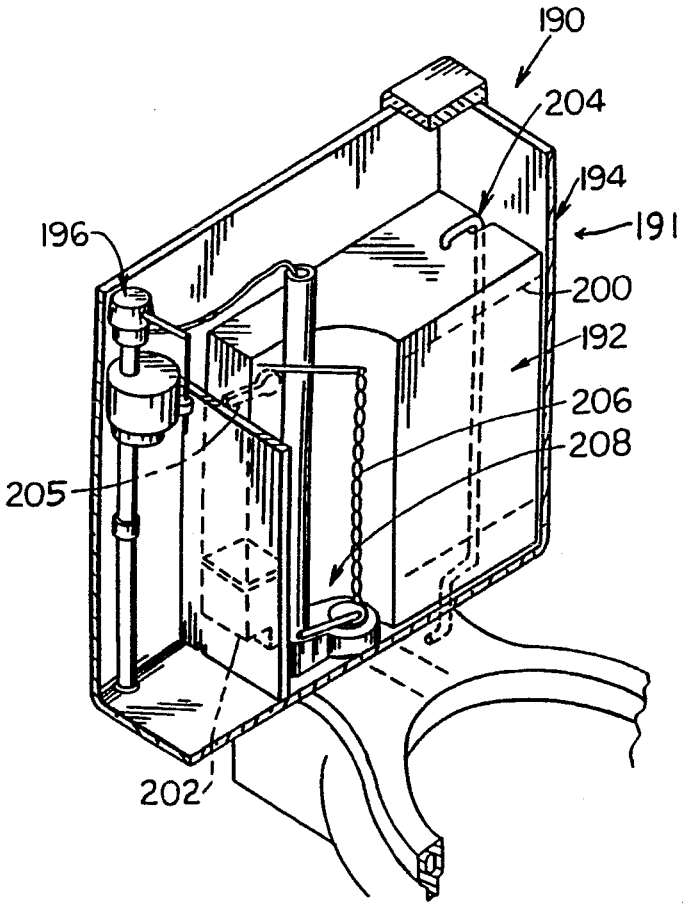
FIG. 4 is a partial sectional isometric view of a vacuum assist, gravity sit-down toilet constructed in accordance with another embodiment of the invention.

FIG. 4 illustrates a gravity energized toilet 190 which is similar in many ways to conventional toilets with tall water tanks. These toilets obtain pressured water to rapidly flow to the toilet bowl, by the force of gravity on the elevated water. The toilet 190 includes a container device 191 that comprises a plastic container 192 which lies within a ceramic water tank 194. When an inlet valve 196 opens after a flushing operation, water in the tank rises to a level indicated at 200. Water in the tank enters the container 192 through an opening 202 near the bottom of the container to fill the container to the level 200. Air in the container passes out through the top of the container and downwardly through a vacuum conduit 204 to a bowl outlet of the construction shown at 24 in FIG. 2. In FIG. 4, with the tank 194 and container 192 filled to a level 200, a lever 205 may be depressed to begin the flush cycle. Depressing the lever 205 lifts a chain 206 to open a flush valve 208 and pass water from the tank into the toilet bowl. Water in the plastic container 192 passes out through the opening 202 to flow out through the open flush valve 208. As the level of water in the container 192 drops, a vacuum is produced in the top of the container, which is transmitted through the vacuum conduit 204 to the trapway. The vacuum conduit 204 corresponds to the vacuum conduit 42 of FIG. 2, and the vacuum conduit connects to a trapway similar to 46 of FIG. 2.

Figure 5:
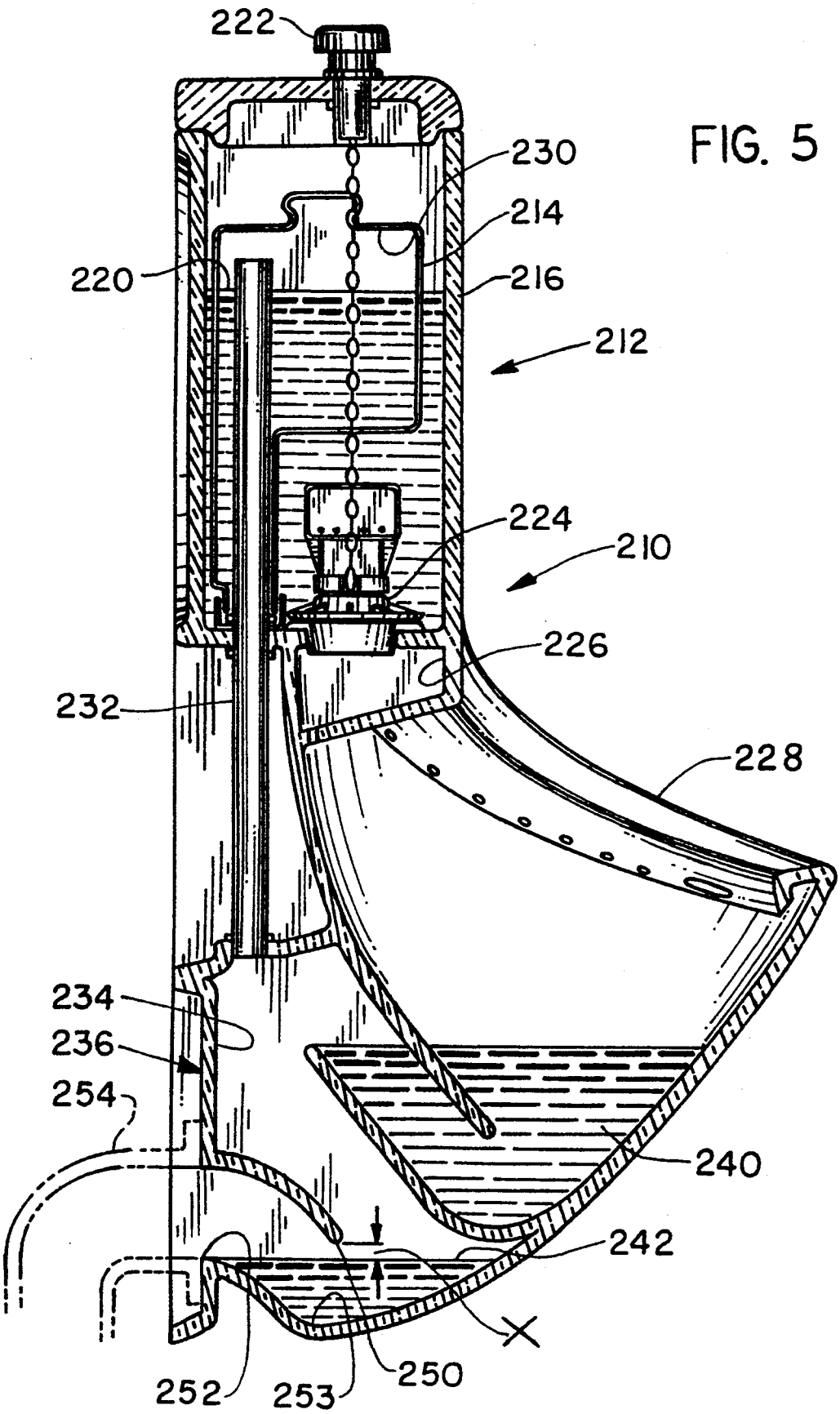
FIG. 5 is a sectional side view of a vacuum assist gravity urinal toilet constructed in accordance with another embodiment of the invention.
Figure 6:
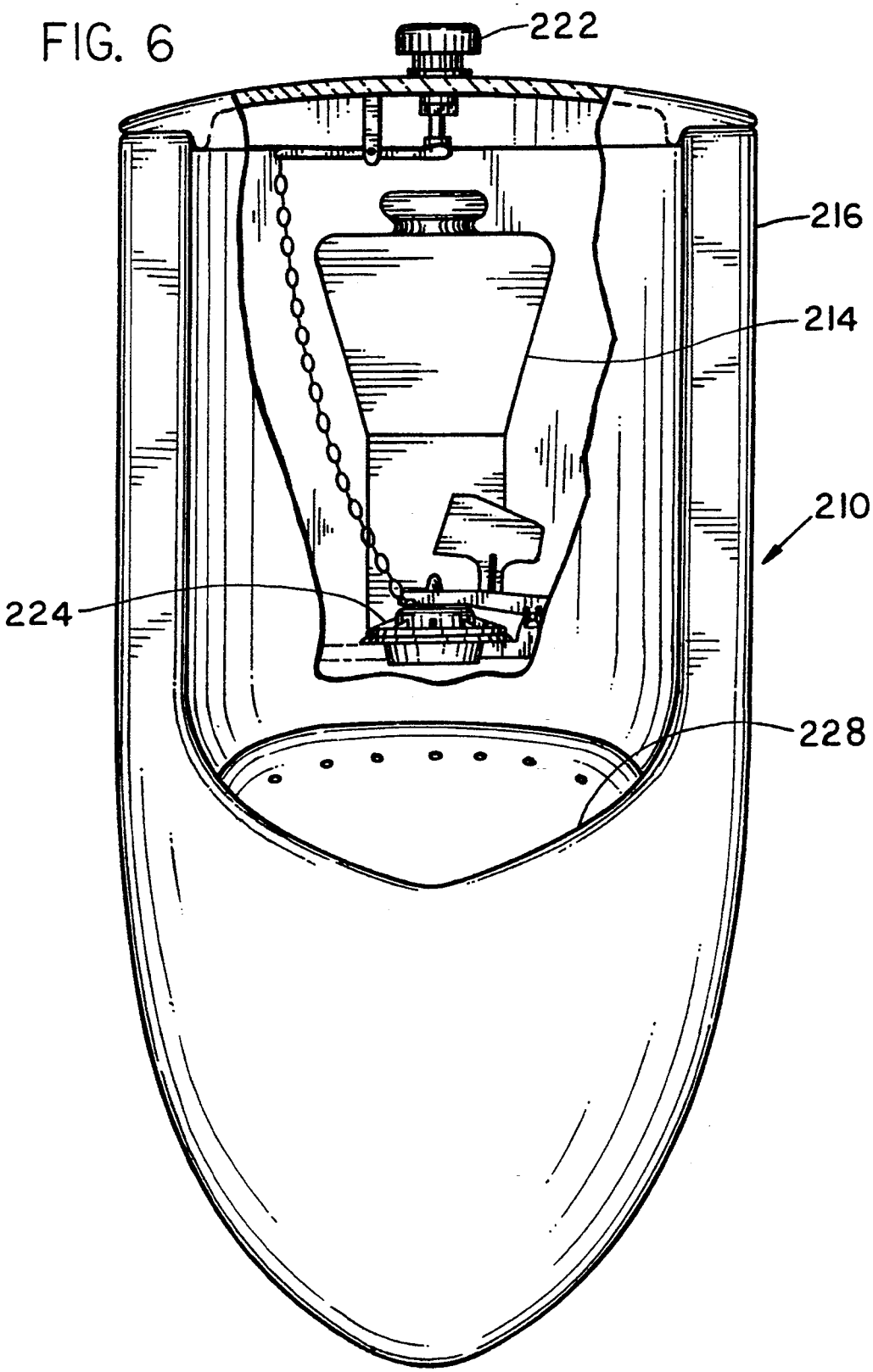
FIG. 6 is a partially sectional front elevation view of the toilet of FIG. 5.

FIGS. 5 and 6 illustrate a urinal toilet 210 which has a gravity-powered vacuum source similar to that of the sit-down toilet of FIG. 4. The toilet 210, includes a water and vacuum apparatus 212 which comprises a plastic container 214 that lies within a ceramic water tank 216. An inlet valve (not shown) allows water to rise to the level 220 in the container 214 and in the water tank volume around and in the container. When a person depresses a button 222, he causes a flush valve member 224 to lift up and allow water to flow out through a flush conduit 226 to the bowl 228.

The drop in water level in the container 214 at the beginning of a flushing, results in a vacuum at the upper part 230 of the container. This vacuum is applied through a vertical vacuum pipe 232 to a trapway 234 of the bowl outlet 236, between upper and lower traps 240, 242. Water flowing to the lower trap closes it for a few seconds near the beginning of a flushing. The lower trap is similar to that of FIG. 2, with a small distance X between the lowermost location 250 of the inside wall and the uppermost location 252 of the outside wall, along an upwardly inclined conduit portion with a closed bottom at 253. The drain 254 extends horizontally and downwardly from the lower trap.

Thus, the invention provides a vacuum assist toilet of the sit-down or urinal (stand-up) type, which is reliable and yet which can reduce the amount of water required in a flushing. The toilet includes a toilet bowl outlet with upper and lower trap devices connected by a trapway, with the toilet applying a vacuum to the trapway near the beginning of a toilet bowl flushing. The lower trap device is unobstructed to the flow of gas therethrough when no water is flowing through the trapway, but is temporarily sealed to the flow of gas when water begins flowing out of the toilet bowl early during flushing. This contains the vacuum in the trapway instead of dissipating it to the drain, and avoids later siphoning off of all water in the toilet bowl. One vacuum source is a pressured type that includes a spring (or weight) biased diaphragm which divides a container into vacuum and water chambers. The water chamber is filled before a flushing, with more than half of the water dumped into the toilet bowl during a flushing (other than bowl refill water). Another vacuum source is a gravity type which relies substantially only on gravity to rapidly flow water from a water tank to the bowl. A separately sealed container has a lower end coupled to the water tank region that contains the flush valve, and has an upper end coupled to a vacuum pipe that extends to the trapway. The vacuum region at the top of the container is in direct contact with the top of the water in the container. It is also possible to use the pressure (usually over 20 psi) of city water to operate an actuator to create a vacuum, instead of using the energy of stored water.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A vacuum assist toilet for connection to a drain comprising:

a water and vacuum apparatus within which water is held and which has an outlet through which water exits during a toilet flushing;

a bowl which can be flushed, said bowl having an inlet and an outlet, said bowl outlet including an upper trap device extending from said bowl, a trapway extending generally downwardly from said upper trap device, and a lower trap device extending from said trapway to extend to said drain;

a flush valve which couples said water and vacuum apparatus outlet to said bowl inlet;

said water and vacuum apparatus including a vacuum source which is coupled to said trapway and which is constructed to apply a vacuum thereto during at least part of the time when water flows from said flush valve into said toilet bowl and from said toilet bowl to said trapway;

said lower trap device is unobstructed to the flow of gas therethrough when no water is flowing through said lower trap device, but is obstructed to the flow of gas therethrough during at least a portion of a flushing when water is flowing into said bowl outlet, to contain said vacuum in said trapway so said vacuum can help draw water and debris out of said bowl.

2. The toilet described in claim 1 wherein:

said lower trap device includes an upwardly inclined conduit portion extending at an upward incline in a downstream direction, said inclined conduit portion having an upper wall and a lower wall, with the upper wall having an upstream end whose lowest location lies slightly higher than the bottom of the downstream end of said lower wall, to provide a pool of water whose top lies slightly below said lowest location of said upper wall when no water flows through said conduit portion.

3. The toilet described in claim 1 wherein:

said water and vacuum apparatus comprises a water tank;

said flush valve is of the type that includes a primarily upwardly facing valve seat, a valve member that can move from a closed position against said seat to an open position above said seat, and a flush handle mounted on said water tank and coupled to said valve member to raise it off said seat;

said water and vacuum apparatus includes a container with upper and lower portions, said container lying stationary within said tank with only said container lower portion communicating with the rest of the tank so a drop in tank water level during a flushing creates a vacuum in said upper portion of the container, said vacuum source also including a conduit coupling the upper portion of said container to said trapway;

said flush valve is horizontally spaced from the bottom of said container to lie outside said container.

4. The toilet descried in claim 1 wherein:

said bowl is a urinal bowl, said water and vacuum apparatus includes an outer water tank and said water and vacuum apparatus includes a container which lies within said water tank and which has a lower end opening to said water tank and an upper end, and said water and vacuum apparatus includes a largely vertical vacuum pipe having an upper end open to the top of said container, said vacuum conduit extending through said tank and having a lower end that is open to said trapway.

5. A method for operating a toilet by rapidly flowing water into a bowl and rapidly flowing water and any debris out of the bowl through an upper trap and down along a trapway toward a drain during a flushing, characterized by:

establishing a lower trap device between the bottom of said trapway and said drain, including maintaining a pool of water in said lower trap device which blocks the passage of air between said trapway and drain at least during part of a flushing, but allowing air to pass between said trapway and drain between flushings;

applying a vacuum to said trapway during at least part of a flushing, to help draw water and debris out of said toilet bowl.

6. The method described in claim 5 wherein:

said step of establishing a lower trap device includes maintaining said pool of water at a level which is slightly less than required for a complete trap so air can pass above said pool when the toilet is not being flushed, and during the early stages of a flushing, flowing water rapidly through said lower trap device to raise the level of said pool to create a complete trap that blocks the passage of air.

* * * * *